US005441256A

United States Patent [19]

Hackman

[11] Patent Number: 5,441,256

[45] Date of Patent: Aug. 15, 1995

[54] METHOD OF CUSTOM MATCHING GOLF CLUBS

[76] Inventor: Lloyd E. Hackman, 1322 Clubview Blvd. S., Worthington, Ohio 43085

[21] Appl. No.: 307,501

[22] Filed: Sep. 15, 1994

Related U.S. Application Data

[63] Continuation-in-part of Ser. No. 998,662, Dec. 30, 1992, Pat. No. 5,351,952.

[51] Int. Cl.[6] ..... A63B 53/12

[52] U.S. Cl. ..... 273/77 A; 273/80 B

[58] Field of Search ..... 273/77 A, 80 B, 186.2, 273/186 R, 77 R

[56] References Cited

U.S. PATENT DOCUMENTS

| | | | |
|---|---|---|---|
| 3,945,646 | 3/1976 | Hammond | 273/186.2 |
| 4,615,526 | 10/1986 | Yasuda et al. | 273/186.2 X |
| 4,630,829 | 12/1986 | White | 273/186.2 |
| 4,878,672 | 11/1989 | Lukasiewicz | 273/186.2 |
| 4,967,596 | 11/1990 | Rilling et al. | 273/186.2 X |
| 4,991,850 | 2/1991 | Wilhelm | 273/186.2 |
| 5,351,952 | 10/1994 | Hackman | 273/77 A |

*Primary Examiner*—George J. Marlo
*Attorney, Agent, or Firm*—Frank H. Foster; Kremblas, Foster & Millard

[57] ABSTRACT

A method for measuring the swing time of a golfer's swing and selecting a golf club having k divided by four times the club's natural frequency ($f_n$) approximately equal to the golfer's swing time. The golfer's swing time is defined as the time elapsed between maximum deflection of a club shaft during downswing until ball impact. The adjustment factor, k is in the equation since the motion of a golf swing is not periodic motion. The adjustment factor, k is determined by measuring the swing time of a representative golfer, finding the preferred $f_n$ for his swing and solving the above equation for k. In the preferred embodiment, an accelerometer is mounted within the club head and is connected to an electronic data processor. A graph of club head angular or radial acceleration versus time is plotted and the swing time is measured from the graph, between either peak angular acceleration or the latest point of maximum slope for radial acceleration and ball impact.

15 Claims, 4 Drawing Sheets

METHOD OF CUSTOM MATCHING GOLF CLUBS

This is a continuation-in-part of application Ser. No. 07/998,662, filed Dec. 30, 1992, and now U.S. Pat. No. 5,351,952.

TECHNICAL FIELD

This invention relates to the field of sports equipment, and more specifically to methods for matching a golf club's natural frequency of oscillation to a golfer's swing time.

BACKGROUND ART

In the sport of golf, it is desirable for a golfer's swing to be the same when using any golf club in the golfer's set of clubs. This consistency results in consistently straight and predictable distance drives. With a typical set of golf clubs a golfer is required to slightly adapt his swing according to different characteristics of each different club in order to obtain a straight and maximum distance drive with that club. It is desirable, however, that every golf club in a set have similar characteristics to allow a golfer to maintain a consistent swing and obtain the optimum results with each club.

A golf club is effectively a cantilevered beam (a club shaft held rigidly at a hand gripped end) having a mass (a club head) mounted to one end opposite the hand gripped end. The golfer's swing begins with the take away during which the golfer raises the club from addressing the ball to a raised position. The club is then reversed and the club is swung downwardly. At the beginning of a golfer's downward swing, the grip end of the club is first moved by the golfer's hands and the club shaft flexes, momentarily leaving the massive head in place. The shaft flexes in reaction to the angular acceleration of the club head and any momentum from the take away. Golfers want the shaft to have straightened from the flexed position and be moving forward at the point in the swing at which the club head impacts the ball, in order to maximize the velocity of the club head. This maximum head velocity maximizes the energy transferred to the golf ball, contributed by the shaft assisting in driving it as far as possible with that club. Additionally, with the club shaft straight, the angled face of the club head is correctly oriented with respect to the shaft, giving the ball the specified loft for that club.

It is desirable that each of the different clubs in a golfer's set have characteristics that cause the club shafts to be straight at ball impact regardless of the club in the set being swung. By always getting a straight shaft at impact regardless of the club each club can be swung identically, with the player's natural swing giving optimum results and allowing the golfer to perfect his swing and obtain consistent results. The problem with making each golf club in a set have the desired characteristics is in measuring the physical characteristics of each golf club, understanding and quantifying the important parts of each golfer's swing, and matching a golf club to a particular golfer's swing.

Numerous patents have been issued for means and methods for determining characteristics of golfers' swings. Hammond, in U.S. Pat. No. 3,945,646, teaches to mount accelerometers at various locations in a golf club. The accelerometers are electrically connected to a data processor which calculates certain position related characteristics of the golf club during a golfer's swing.

This invention uses the accelerometers for analyzing the swing of a particular golfer to correct the swing, not for determining characteristics of a golfer and then matching those characteristics to golf clubs.

In U.S. Pat. No. 4,615,526, Yasuda et al. mount magnets and sensors to a golf club and a platform. The apparatus is used during the swing of the club to determine the velocity of the club head and angle of approach at, and near, ball impact. These characteristics of the golfer's swing are also used to analyze a golf swing for the purpose of correction, not to match a golfer to a golf club.

Additional U.S. Pat. Nos. 4,630,829, 4,878,672, 4,967,596, and 4,991,850 teach the use of electrical and mechanical devices for measuring velocity, centrifugal force during club swing, and impact energy of a ball with a club head. Most of these inventions are used to determine characteristics about a golfer's swing in order to correct or change the golfer's swing. None of the prior art inventions uses characteristics of a golfer's swing to determine the flexibility a golf club shaft should have for that golfer.

It is known to take a plurality of golf clubs that have different natural frequencies of oscillation and, by trial and error, find the natural frequency of a golf club that best matches a particular golfer. This is done by the golfer taking numerous swings with each golf club, and choosing the one which gives the golfer the best respective results, such as drive distance and straightness of drive.

The need exists for a method for measuring specific characteristics of a golfer's swing, and matching a golf club or a set of golf clubs to those characteristics.

BRIEF DISCLOSURE OF INVENTION

The invention is a method of determining an adjustment factor, k for matching a golfer and a golf club to maximize club head momentum upon impact with a ball. The golf club has a natural frequency off vibration in a cantilevered beam mode of oscillation when held at a grip end of a club shaft. The golf club has a club head mounted to the opposite, narrow shaft end which oscillates along an arcuate path about the grip end at a natural frequency of vibration. The natural frequency of vibration is equal to the adjustment factor, k divided by the product of 4 times a golfer's swing time. Swing time is the time elapsed from the moment of maximum club head angular acceleration during down swing until the moment of ball impact.

The method comprises measuring the swing time, s, of a golf swing and selecting, from a plurality of golf clubs of different natural frequency, a golf club which delivers maximum club head momentum upon ball impact when swung in the measured golf swing. The method further comprises calculating k wherein k equals 4 times s times the natural frequency of vibration of a selected golf club.

The preferred method of the invention contemplates using a professional golfer as the measured golf swing. The invention further contemplates a method for matching the golfer to a golf club to maximize club head momentum upon ball impact. This method comprises measuring the swing time, s, of a representative golf swing, calculating the adjustment factor, k, as described above, measuring the golfer's swing time, and selecting for the golfer a matching golf club wherein k divided by 4 times the matching club's natural frequency of vibration is equal to the golfer's measured swing time.

The method for matching a golfer to a golf club may be performed without calculating the adjustment factor k, by having a k predetermined by some other method, or using a k which is commonly known in the golf industry. The method then includes measuring the golfer's swing time and then selecting a golf club wherein the adjustment factor k divided by four times the club's natural frequency of vibration is substantially equal to the golfer's measured swing time.

Figure 1:
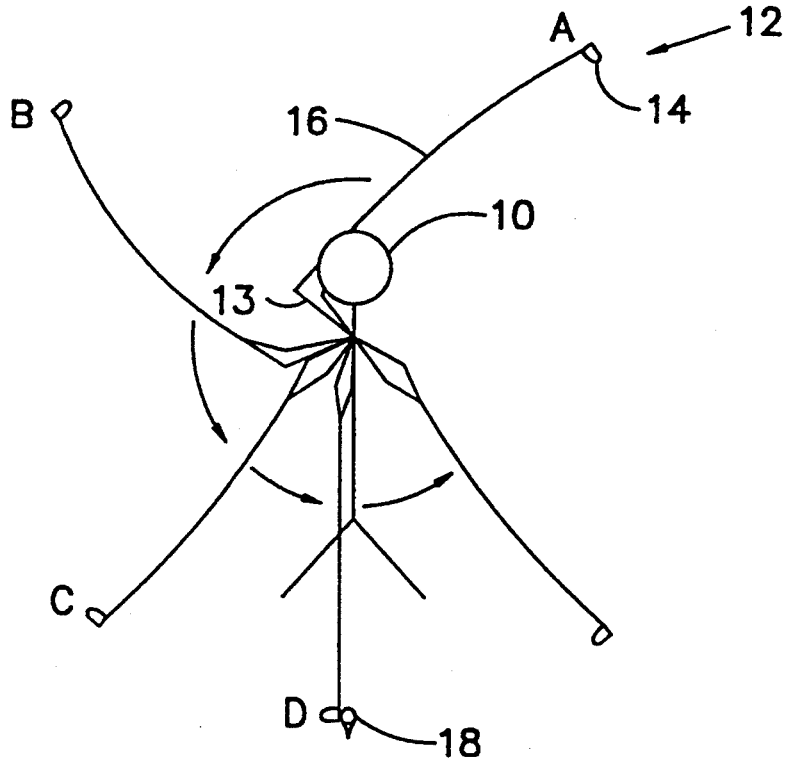
FIG. 1 is a schematic view illustrating a golfer in progression through a golf swing.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

A golfer 10 is illustrated in FIG. 1 swinging a golf club 12 through multiple positions of a typical golf swing. With the club head at rest at position A, the golfer 10 begins his golf swing, accelerating the golf club 12 by applying a force to a grip end 13 of the club 12. The portion of the golf swing of concern begins when a club head 14 initiates a downward acceleration. This is either when the golf club 12 is at rest and a downward force is applied to begin the swing downward, or when the golf club 12, having an upward velocity due to backswing, is suddenly stopped and reversed in direction by a downward force, initiating downswing. When the grip end of the club is accelerated, the club shaft begins to be deflected and begins to apply a force to the club head. That force is a spring force equalling the product of the amount of deflection multiplied by the spring constant. The spring force begins accelerating the club head in accordance with Newton's law F=ma. As club shaft deflection is increased by the force applied to the grip by the golfer, resulting in acceleration of the grip, the acceleration increases until maximum deflection is reached at point B also corresponding to peak acceleration.

Therefore, when the club head 14 reaches position B, it has an increased velocity, and maximum potential energy stored in the deflected club shaft and available to accelerate the club head 14 to a higher total velocity at impact. The club head 14 has maximum potential energy because the flexible golf club shaft 16 has deflected a maximum amount from its initially straight, undeflected shape. Acceleration decreases during the swing after the maximum at position B while club head velocity continues to increase. When the golf club 12 reaches position C, the velocity of the club head 14 is increased still further and the acceleration is decreased from its positive maximum at position B, with the shaft 16 somewhat straighter. At position B, where shaft deflection is maximum, club head velocity is the velocity of the radially oriented club shaft axis extending through the club grip. After position B, club head velocity is the sum of the velocity of the radially oriented axis of the club shaft extending through the club grip and the velocity of the club head relative to that axis resulting from the potential energy of the deflected club shaft being used to move the club head forward with respect to that axis.

When the golf club 12 reaches position D, an infinitesimal instant before impact with a ball 18, the club head 14 preferably has maximum velocity, and the angular acceleration of the club head 14 is substantially reduced or near zero. At the instant of impact with the ball 18, the acceleration of the club head 14 becomes negative (deceleration) and its velocity decreases quickly, due to the significant energy transfer from the club head 14 to the ball 18. The shaft 16 is preferably straight when the club head 14 impacts the ball 18. After the ball 18 has been hit and is driven away from the club head 14, the club head 14 acceleration changes positively, increasing towards zero from its negative value.

Figure 5:
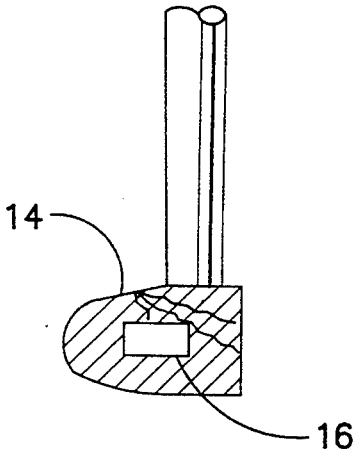
FIG. 5 is a side view in section illustrating a preferred embodiment of the present invention.
Figure 6:
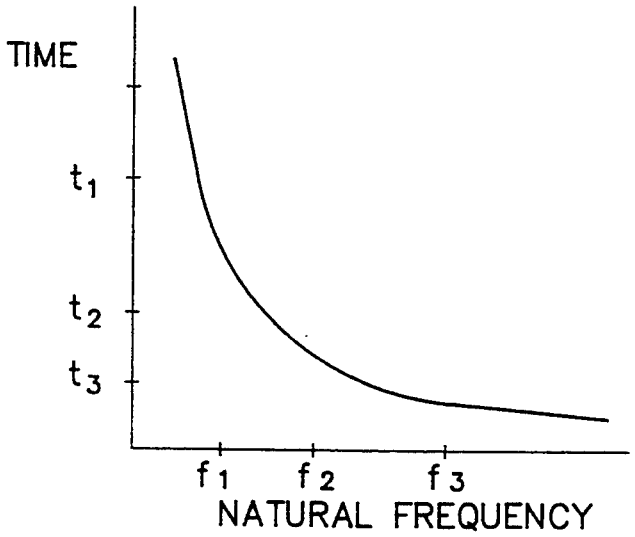
FIG. 6 shows a plot of swing time (t) versus natural frequency of vibration (f) for three examples, without using specific values.

In the preferred embodiment of the present invention an accelerometer 19 is mounted in or near the club head 14, as shown in FIG. 5 in detail, to measure the above described changes in acceleration with respect to time that the club head 14 undergoes. By connecting the accelerometer 19 to an electronic data processor (not shown), it is possible to plot a graph of acceleration versus time according to the data received from the accelerometer 19. The acceleration measured can be radial acceleration, angular acceleration, tangential acceleration or resultant acceleration. Preferably the accelerometer 19 measures radial acceleration which is directly proportional to angular velocity.

Figure 2:
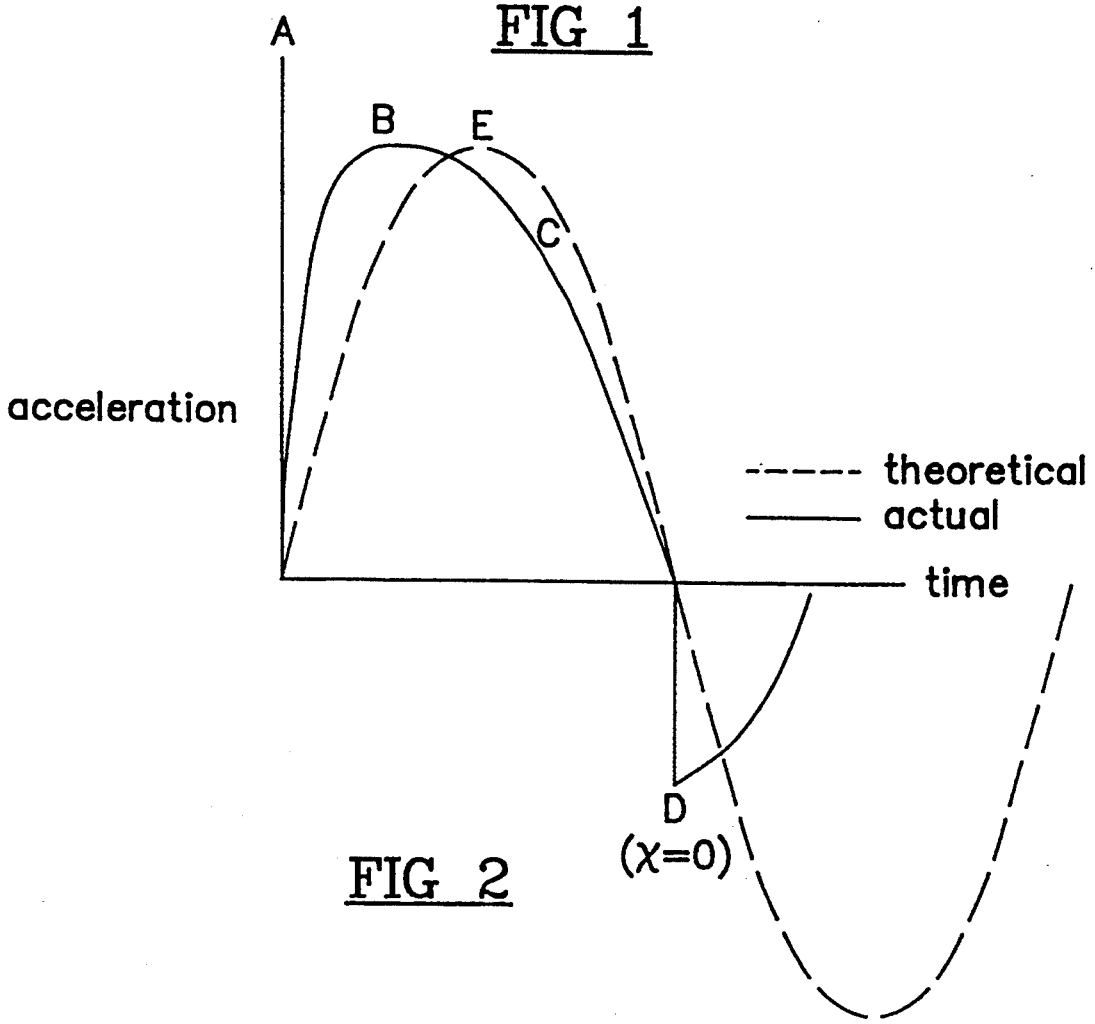
FIG. 2 is a graph illustrating angular acceleration versus time.
Figure 7:
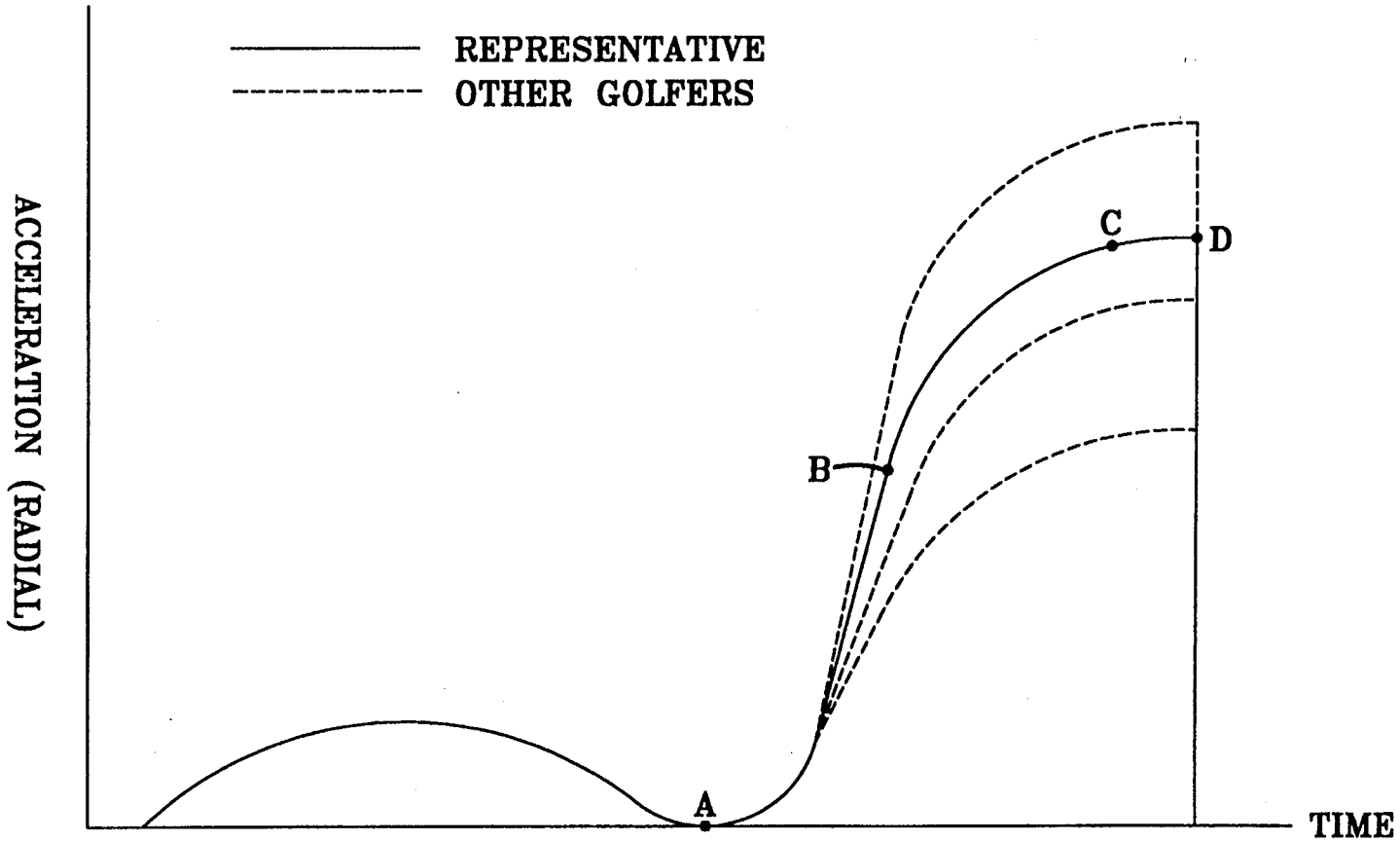
FIG. 7 is a graph illustrating radial acceleration versus time.

A graph of angular acceleration (which is the first derivative of angular velocity and therefore is directly proportional to the first derivative of radial acceleration) versus time is illustrated in FIG. 2, and a graph of radial acceleration (which is proportional to angular velocity) is plotted against time as shown in FIG. 7. The positions A, B, C and D on the graphs of FIGS. 2 and 7 correspond with the positions A, B, C and D of the golf swing illustrated in FIG. 1. Although the graph of FIG. 2 is used to explain the principles of the present invention, preferably radial rather than angular acceleration is measured since it gives a greater variation of data points, which makes finding a characteristic data point easier. Swing time is measured as the time elapsed between points B and D. These points represent the latest point of maximum slope and ball impact, respectively. In all cases swing time is the time elapsed from the time of maximum club shaft deflection until the time of ball impact. There are many ways to measure this swing time.

The graph of FIG. 2 shows both a theoretical curve and an actual curve. The actual curve is the curve obtained with the preferred embodiment when an accelerometer 19 is mounted in a golf club head and a golfer performs his typical golf swing. The theoretical curve represents perfectly (ideal) periodic motion of a golf club mounted in a device which permits vibration of the club in a cantilevered beam mode of oscillation for purposes of explanation. The actual curve differs from the theoretical curve since there is both a transient force applied by a golfer at initiation of the golfer's swing and a non-sinusoidal force applied by the golfer during the swing which are characteristic of the nonperiodicity inherent in human motion.

Although the actual curve generated by a human golfer differs from the theoretical curve obtained, it is possible to use the theoretical curve and the principles accompanying periodic motion to approximate the actual curve. The approximation is accurate enough that the swing time of a golfer can be used to determine, with substantial accuracy, the natural frequency of a golf club which will match the golfer's swing time.

In determining the swing time of a golfer, the time elapsed between position B (the maximum angular acceleration) and position D (the drop in acceleration characteristic of impact with the ball) on the actual curve of FIG. 2 is measured. This time value is one-fourth of the period of a theoretical curve which the actual curve approximates. Since the period is the inverse of the natural frequency ($f_n$) the ideal theoretical swing time is $$\text{swing time} = \frac{1}{4f_n}. \qquad \text{(Equation 1)}$$

Since the motion of a golfer initiating downswing is a transient, non-sinusoidal motion, it introduces start-up error, or discrepancies relative to ideal periodic motion. A golfer does not apply a periodic, sinusoidal driving force to the club grip which is typical of the periodic motion of a driven resonant body, usually studied in the dynamic motion of bodies. Instead, the golfer applies an accelerating force at the beginning of the swing which decreases as the swing progresses beyond point B. Between points B and D, this force is not 0 and it is not a sinusoidal driving force. Accordingly, the peak of the actual acceleration is shifted by an amount dependent upon the golfer's characteristic swing from its theoretical time closer to the beginning of the swing in this illustration. Therefore, a correction, or adjustment factor must be used in calculating the golfer's swing time to get the actual curve (non-sinusoidally driven club) to more closely approximate the theoretical curve (sinusoidally driven club). Equation 1 is, therefore, only approximate for a golfer's swing, and requires an adjustment factor k giving $$\text{Swing time} = \frac{k}{4f_n}. \qquad \text{(Equation 2)}$$

The object of the present invention is to measure the swing time of a golfer's swing and calculate a natural frequency, $f_n$ of a golf club that will result in maximum net club head velocity at the time of ball impact. A golf club having a measured natural frequency matching the natural frequency calculated from equation 2 will match the golfer's swing time.

For measuring the natural frequency of the club, it is well known to rigidly mount a conventional golf club by its grip end in a clamping machine, displace the club head and release it, causing the club to oscillate about the grip end along an arcuate path. This cantilevered beam mode of oscillation is illustrated by the theoretical curve of FIG. 2. It is also known that the frequency of oscillation of that golf club is its natural frequency. By varying both the length of the club shaft, the stiffness and other physical properties of the club shaft, and the mass of the club head, the natural frequency of the golf club can be varied.

Figure 3:
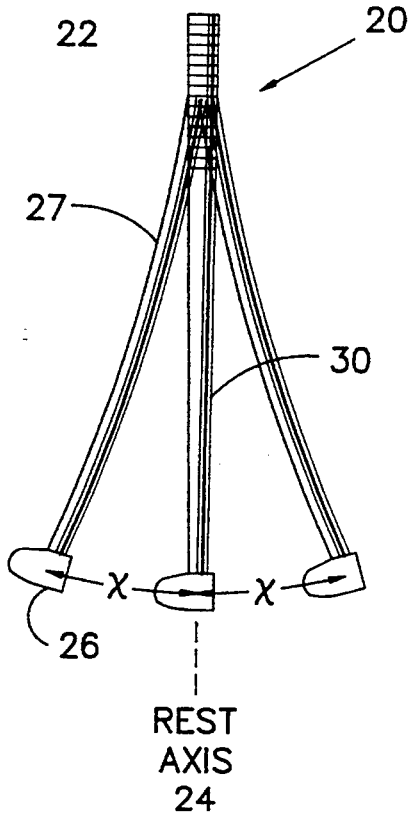
FIG. 3 is a side view illustrating deflection positions of a golf club.

An illustration of a golf club 20 oscillating about a grip end 22 is shown in FIG. 3. The golf club 20 is shown as it deflects when it is swung through a typical golf swing or, similarly, as it is oscillated when held in a clamping machine, displaced and released. An imaginary rest axis 24 (the previously mentioned axis through the grip), extends from the grip end 22 and passes linearly through the undeflected golf club shaft 30, shown in the center of the illustration of FIG. 3. During deflection of the golf club 20 in either direction from the rest axis 24, the club head 26 is displaced a distance X from the rest axis 24, shown in FIG. 3.

The time changing angular acceleration of the clamping machine mounted golf club 20 is illustrated by the theoretical curve shown in FIG. 2. When the oscillating golf club 20, held at its grip 22 end, passes through the rest axis 24 (at x=0), the angular acceleration of the club head 26 is zero and its velocity is maximum. It is as the club head 26 passes through the rest axis 24 that the velocity of the club head 26 with respect to the rest axis 24 is maximum, and therefore where it is desirable that the club head 26 strike a golf ball when the club 20 is swung by a golfer.

The reason why a golfer wants maximum club head 26 velocity with respect to the rest axis 24 at ball impact is that the golf club 20 has two important velocity components when swung by a golfer. The first velocity component is the velocity of the club head 26 with respect to the rest axis 24 as described above. Secondly, there is the angular velocity of the moving rest axis 24 which is a function of the angular velocity of the golfer's hands at the grip 22 end. The net velocity is the sum of these two velocities. It is desirable to maximize the velocity of the club head 26 with respect to the rest axis 24 at ball impact to maximize the net velocity of the club head 26 upon impact. This will impart maximum momentum to the golf ball, and will drive the golf ball the greatest distance for the particular golf club.

There is a difference between the way the force is applied by a person swinging a golf club holding it at the grip end, and the way the force is applied when the golf club is in a clamping device measuring the natural frequency. An adjustment factor, as described above, is necessary for correcting this discrepancy between perfect periodic motion and the actual motion of a golfer's swing.

The theoretical, periodic motion of the oscillating golf club of FIG. 3, shown graphically in FIG. 2, is what use of equation 1 assumes a golfer's swing approximates. As a golfer progresses through his swing, the angular acceleration reaches a peak value and then decreases to zero over time and takes a characteristic negative plunge at ball impact. If the time between peak acceleration and ball impact is measured (with an accelerometer) and is equated to the inverse of four times the natural frequency of a golf club (as measured in a clamping machine), the golfer using that golf club should have a straight club shaft, and have maximum net velocity of the club head at ball impact once the adjustment factor has been included to make the approximation more accurate.

As the club head decreases in acceleration from its actual peak acceleration, an assumption is made that the actual decrease in club head acceleration from peak to zero occurs more quickly than it actually does, similar to the theoretical curve, allowing the club head to move as a freely oscillating body back toward its rest axis like the club 20 clamped in a device shown in FIG. 3. This approximation assumes either a complete lack of force applied by the golfer on the rest axis (the grip) after the peak angular acceleration is reached at point B or the application of a sinusoidal drive with a slight phase lead. This assumed lack of an external force or sinusoidal drive allows the deflected shaft of the club to begin to straighten like a freely oscillating body with the rest axis having constant velocity and zero acceleration.

In the case of a golf club which is held in a clamp, bent and released to oscillate, the rest axis has no acceleration, allowing for the analogy to be drawn between a golf club being swung (an actual external force applied to the club after peak acceleration) and a club mounted in a clamp (no external force applied to rest axis after peak acceleration). The approximation which permits measuring the time between maximum angular acceleration (analogous to release of the bent, clamped club) and ball impact (at $x=0$ for clamped club) and equating that to the inverse of four times the natural frequency departs from the theoretical situation only to the degree that the external force applied to the rest axis for a golfer swinging does not actually decrease as rapidly to zero as the theoretical after maximum angular acceleration. A non-sinusoidal and/or non-in-phase force is actually applied by a human golfer to the rest axis between maximum angular acceleration and ball impact which shows the decrease to zero. The adjustment factor, k makes up for the fact that the actual departs from the theoretical, and allows the theoretical principles to be applied to the actual situation.

By assuming that once the club head reaches maximum angular acceleration in a golfer's swing, the club approximates a club mounted in a frequency measuring machine, the matching of a golfer's swing time to a particular golf club's natural frequency is mathematically accomplished with equation 2.

Therefore, what is effectively being measured is the actual amount of time it takes a deflected golf club shaft to straighten itself: whether released while held in a clamp and deflected, or released from deflection in a golfer's unique swing. This equation is then used to match the unique swing time to a particular golf club (having a known natural frequency).

The time in both cases is approximately equal to one-fourth the inverse of the natural frequency, herein called the swing time. The swing time is the amount of time it takes in a golfer's swing for the golf club to impact the golf ball from maximum club shaft deflection, ie. peak acceleration. This swing time can be measured in many ways. With a good approximation of swing time, a golf club can be selected which will become straight the time ball impact occurs to give the club head the maximum net velocity for the particular golfer.

The preferred golf club, effectively a cantilevered beam, deflects a distance X under acceleration applied by a golfer swinging the club. The distance X the golf club head is deflected is proportional to the amount of angular acceleration of the golf club caused by the golfer. The equation $$F=ma$$

where:

m is the mass of the golf club (primarily the head); and a is the angular acceleration of the golf club rest axis shows that a force F applied to the golf club grip results in a proportional acceleration in the golf club. The equation $$F=xk_s$$

where:

x is the displacement of the club head from the rest axis; and $k_s$ is the spring constant of the club shaft shows that a force F applied to a golf club grip by a golfer results in a deflection of the club shaft, proportional to the force applied. By equating the above equations, the resultant is $$ma=xk_s$$

This equation shows that an angular acceleration of the golf club rest axis results in a proportional deflection of the club shaft, displacing the club head a distance x from the rest axis, proportional to the acceleration applied. The preceding equations illustrate the effect that angular acceleration has on deflection of the golf club shaft, and the displacement x of the club head from the rest axis. Of course, a finite time must be allowed for an acceleration to result in a given deflection due to the impossibility of instantly displacing a mass (club head).

The present invention involves first locating both the peak angular acceleration and the ball impact in a golfer's swing and then determining the time between them (the swing time). From that time interval, the desired natural frequency for a club is determined. A golf club is then selected from an inventory of pre-manufactured clubs or a club is custom made to have that natural frequency that will cause it to complete the displacement from deflected to straight in the amount of time it takes the golfer to swing from maximum acceleration to ball impact.

As described above, the fact that the actual, measured acceleration curve is an approximation of the theoretical acceleration curve requires that the adjustment factor, k be obtained in order to more accurately determine the natural frequency necessary for a particular golfer. The adjustment factor, k is determined in the preferred embodiment by a plurality of steps as follows.

First, the time or position in a swing at which peak angular acceleration is reached and the characteristics of each person's swing after peak acceleration vary among golfers. FIG. 7 illustrates the swings of many golfers as plotted with radial acceleration versus time. Because of these differences, a swing representing many golfers' swings is measured. The first step in calculating the adjustment factor k is measuring the radial acceleration with respect to time and obtaining the swing time of a golfer who has a swing representative of most golfers. By representative, it is meant that the golf swing of this representative golfer should have characteristics which accurately represent the golf swings of most golfers. This means the representative's swing should have a swing time intermediate of the times that most golfers have, or the representative may be a composite or average of a sizeable sampling of golfers. In the preferred embodiment, this representative is a professional golfer, although it could also be a multiply adjustable machine that swings a golf club or any other suitable representative.

The second step in determining the adjustment factor k after obtaining a representative swing time is finding the natural frequency of a golf club which gives that representative golfer maximum club head velocity at ball impact. This is a trial and error process in which the representative golfer swings a plurality of golf clubs each at a different natural frequency. This process should result in the selection of a particular golf club of a predetermined or subsequently measured natural frequency, the club being selected from the plurality of golf clubs which are swung through the representative golf swing. The club head velocity of each of the plurality of golf clubs swung is measured as the clubs are swung through the representative golfer's consistent swing.

In the preferred embodiment a professional golfer, who has the representative golf swing, swings a plurality of golf clubs, and the velocity of the club head (at ball impact when swung in the representative golf swing) is measured. The golf club giving the greatest club head velocity at ball impact is the particular golf club which is selected. Once a particular golf club is selected as the club giving the greatest club head velocity at ball impact for the representative golfer, the natural frequency of that golf club is noted and used below for calculating k. A less scientifically accurate, yet related characteristic of the representative golfer's swing may be measured, such as the distance golf balls are driven with each of the plurality of clubs. The important factor to be considered is the club's kinetic energy at ball impact which determines the amount of energy that can be imparted to a contacted ball. Velocity and ball distance are increasing functions of club head energy. There are many other measurable or calculable parameters which relate to kinetic energy. The representative golfer swings each of the plurality of golf clubs with his consistent swing to determine which club is most suited to the representative golfer.

The next step in calculating the adjustment factor k involves solving Equation 2 for k using the representative's swing time and the natural frequency obtained in finding the golf club giving the representative the greatest club head velocity at ball impact. The equation $k = \text{swing time} * 4 * f_n$ is obtained. Because the representative golfer's golf swing accurately represents the golf swings of most golfers, the adjustment factor k obtained for that swing time can then be used to adjust the measured swing times for other golfers to obtain a natural frequency which accurately represents the swing time of the other golfers.

The Applicant has calculated the adjustment factor k using a professional golfer as the representative and has determined k to be substantially 1.6 for this representative. The value of k can vary widely based upon the selection of the representative. The Applicant has made limited experimentation in determining k. Based upon these experiments, the amount 1.6 has been determined to be k. However, using the invention, a substantially different value for k could foreseeably be obtained based upon the Applicant's recognition of the wide variation in the swing characteristics of all potential representatives. If a k different from 1.6 is obtained, it would still work in the present invention. Using a different golfer, or an adjustable golf swinging machine such as is marketed under the name "IRON BYRON", a different adjustment factor k may very foreseeably be obtained.

Figure 8:
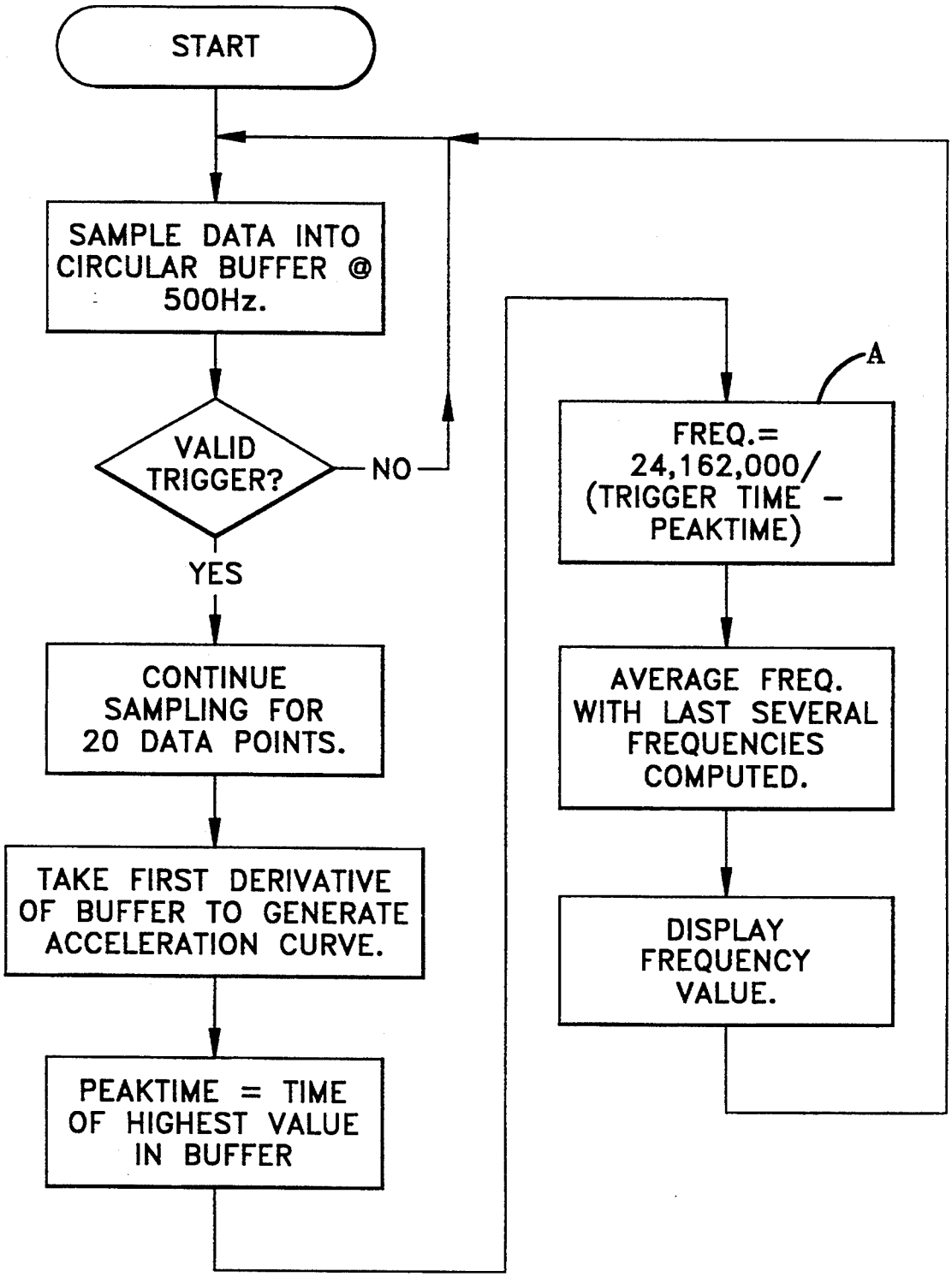
FIG. 8 is a flow chart.

FIG. 8 illustrates a flow chart used in the preferred embodiment of the present invention for calculating and displaying a frequency value from data received by an accelerometer. The 24,162,000 shown in box A contains the adjustment factor k combined with the internal timing of the computer processor and other numbers. 24,162,000 is equal to $\frac{1}{4}$ times k (1.6108) times 60 million microseconds per minute. In box A, "trigger time minus peak time" represents the swing time of the golfer.

If the golfer 10 in FIG. 1 swings the golf club 12 upwardly and does not consciously or knowingly stop the club 12 to allow the golf club shaft 16 to come to rest before initiating downswing, the present method of measuring swing time still works. By whipping the club 12 up in the upswing and then suddenly swinging it downwardly, the club head none the less instantaneously comes to rest. The deflection of the shaft 16 will be increased over starting the swing from a conscious rest, increasing velocity at the impact with the ball 18 if the golf club 12 is correctly chosen. The accelerometer method measures swing time as beginning at maximum downward acceleration. When the golf club 12 is swung upwardly and suddenly stopped and swung downwardly, the first application of force to the golf club 12 by the golfer 10 in the downward direction and will cause a downward acceleration to be sensed by the accelerometer. When this downward acceleration reaches a maximum, time will begin to be measured and will stop at ball impact. This is the same method used when the club 12 is allowed to come to rest prior to downswing initiation.

The accelerometer used in the present invention is of the type conventionally used, having small size and weight, capable of being mounted within a golf club head.

Figure 4:
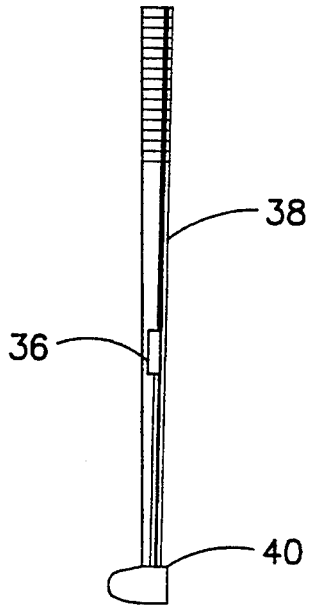
FIG. 4 is a side view illustrating an alternative embodiment to the present invention.

It is possible, as shown in FIG. 4, to install a strain gauge 36 on a golf club shaft 38 to sense deflection or stress of the golf club shaft 38 during the swing of a golfer. The strain gauge 36 would be connected to an electronic data processor which plots a graph of deflection versus time. The swing time is measured as beginning when deflection of the golf club shaft 38 begins to decrease after reaching a maximum, and ending at ball impact. To measure ball impact, a sensor, such as a piezoelectric crystal, can be installed in the face of the club head 40.

Although most people accelerate following the actual curve shown in FIG. 2, in which acceleration decreases after ball impact, an extremely strong person may continue accelerating after ball impact. For this person, the present method will still result in a golf club having a shaft which passes through the rest axis by measuring the swing time and equating it to the inverse of four times the natural frequency. Most people, however, have approximately zero acceleration at ball impact.

It is another object of the present invention to tune all of the golf clubs in a golfer's set to the natural frequency of the golfer's swing for each particular club.

The swing time is defined above as the time between the maximum club head angular acceleration and ball impact (which gives a characteristic deceleration). Actual ball impact is not essential and can be determined by other means, such as by sensing club head position where impact would occur, for example by interrupting a light beam directed to a photo cell and passing through a location where the ball would be positioned. The acceleration curve can be narrower or broader than those shown in FIG. 2. The narrower curve will more quickly go from maximum to zero acceleration, more closely matching the assumptions made above, and vice versa for the broader curve. Additionally, the acceleration may reach a peak value and level off, dropping after some time, which will increase error, unless the time is measured from the time the acceleration begins to decrease, until ball impact. For most people the maximum acceleration coincides with the start of decreasing acceleration.

The graph of FIG. 2 is not necessarily representative of all golfers or even a lot of golfers, but is merely representative of one possible type of golf swing.

While certain preferred embodiments of the present invention have been disclosed in detail, it is to be understood that various modifications may be adopted without departing from the spirit of the invention or scope of the following claims.

I claim:

1. A method for matching a golfer to a golf club to maximize club head velocity upon ball impact, the golf club having a natural frequency of vibration in a mode of oscillation of a cantilevered beam, the club having a club head mounted to the opposite shaft end which oscillates along an arcuate path about the grip end, the method comprising: '(a) measuring the golfer's swing time from the moment of maximum club head acceleration during downswing until the moment of ball impact; and (b) selecting for the golfer a golf club wherein divided by four times the club's natural frequency of vibration is substantially equal to the golfer's measured swing time.

2. A method in accordance with claim 1 wherein selecting a golf club further comprises measuring the natural frequency of a golf club in the mode of oscillation of a cantilevered beam.

3. A method in accordance with claim 2 wherein the adjustment factor k is substantially 1.6.

4. A method in accordance with claim 3 wherein measuring the golfer's swing time further comprises mounting an accelerometer to a golf club, and measuring the difference in time between maximum angular acceleration and high deceleration of ball impact.

5. A method of determining an adjustment factor, k for matching a golfer with a matching golf club to maximize club head velocity upon impact with a ball, the matching golf club having a natural frequency of vibration in a cantilevered beam mode of oscillation when held at a grip end of a club shaft, the matching golf club having a club head mounted to the opposite, narrow shaft end which oscillates along an arcuate path about the grip end at a natural frequency of vibration equal to the adjustment factor, k, divided by the product of 4 and the golfer's swing time, the method comprising:

(a) measuring the swing time, s of a representative golf swing;

(b) selecting, from a plurality of golf clubs of different natural frequency, a golf club which delivers maximum club head velocity upon ball impact when swung in the measured golf swing; and (c) calculating k, wherein $$k=4*f_n*s,$$

where $f_n$ is the natural frequency of vibration of the selected golf club.

6. A method in accordance with claim 5 wherein the representative golf swing is that of a golf club swinging machine.

7. A method in accordance with claim 5 wherein the representative golf swing is that of a golfer.

8. A method for matching a golfer to a matching golf club to maximize club head velocity upon ball impact, the matching golf club having a natural frequency of vibration in a mode of oscillation of a cantilevered beam when held at a grip end of a club shaft, the matching club having a club head mounted to the opposite, narrow shaft end which oscillates along an arcuate path about the grip end, the method comprising:

(a) measuring the swing time, s of a representative golf swing;

(b) selecting, from a plurality of golf clubs of different natural frequency, a selected golf club which delivers maximum club head velocity upon ball impact when swung in the measured golf swing;

(c) calculating an adjustment factor, k, wherein $$k=4*f_n*s,$$

where $f_n$ is the natural frequency of vibration of the selected golf club;

(d) measuring the golfer's swing time; and (e) selecting for the golfer a matching golf club wherein k divided by four times the matching club's natural frequency of vibration is equal to the golfer's measured swing time.

9. A method in accordance with claim 8 wherein selecting a matching club further comprises measuring the natural frequency of the matching golf club in the mode of oscillation of a cantilevered beam.

10. A method in accordance with claim 9 wherein measuring the golfer's swing time further comprises attaching an accelerometer to a test golf club, and measuring the difference in time between maximum angular acceleration and high deceleration of ball impact.

11. A method in accordance with claim 10 wherein the accelerometer is mounted to a head of the test club.

12. A method in accordance with claim 11 wherein the method further comprises selecting a plurality of matching golf clubs, each of the plurality of matching clubs having k divided by four times the club's natural frequency equal to the golfer's measured swing time.

13. A method in accordance with claim 10 wherein the attached accelerometer measures the radial acceleration of the test golf club.

14. A method in accordance with claim 8 wherein measuring the golfer's swing time further comprises mounting at least one strain gauge to the shaft of a test golf club, and measuring the difference in time between the moment of maximum deflection or stress of the test golf club shaft, and the moment of ball impact.

15. A method in accordance with claim 14 wherein measuring the golfer's swing time further comprises mounting a sensor in the test golf club head for indicating ball impact.

* * * * *

UNITED STATES PATENT AND TRADEMARK OFFICE

CERTIFICATE OF CORRECTION

PATENT NO. : 5,441,256

DATED : Aug. 15, 1995

INVENTOR(S) : Hackman

It is certified that error appears in the above-indentified patent and that said Letters Patent is hereby corrected as shown below:

Column 11, Claim 1, line 37, after "wherein" insert ---an adjustment factor k---.

Signed and Sealed this

Fourth Day of January, 2000

*Attest:*

*Attesting Officer*

*Acting Commissioner of Patents and Trademarks*